US005286948A

United States Patent [19]

Landa et al.

[11] Patent Number: 5,286,948

[45] Date of Patent: Feb. 15, 1994

[54] FUSING APPARATUS AND METHOD

[75] Inventors: Benzion Landa, Edmonton, Canada; Naseem Yacoub, Herzelia; Hanna Pinhas, Holon, both of Israel

[73] Assignee: Spectrum Sciences B.V., Rotterdam, Netherlands

[21] Appl. No.: 895,169

[22] Filed: Jun. 5, 1992

Related U.S. Application Data

[63] Continuation of Ser. No. 735,801, Jul. 25, 1991, abandoned, which is a continuation of Ser. No. 293,431, Jan. 4, 1989, Pat. No. 5,157,238.

[30] Foreign Application Priority Data

Sep. 8, 1988 [GB] United Kingdom ..... 8821107
Oct. 4, 1988 [GB] United Kingdom ..... 8823258

[51] Int. Cl.[5] ..... G03G 15/20

[52] U.S. Cl. ..... 219/216; 219/469; 355/290

[58] Field of Search ..... 219/216, 469, 470, 471; 355/290; 29/123, 129, 113.2, 113.1

[56] References Cited

U.S. PATENT DOCUMENTS

| | | | |
|---|---|---|---|
| 3,245,511 | 4/1966 | Macklin | 29/113.1 |
| 3,394,245 | 7/1968 | Waldrop | 219/469 |
| 3,937,919 | 2/1976 | Clerx | 219/216 |
| 4,001,544 | 1/1977 | Heinzer | 219/216 |
| 4,272,872 | 6/1981 | Hess | 29/113.1 |
| 4,395,109 | 7/1983 | Nakajima | 219/216 |
| 4,420,680 | 12/1983 | Itoh | 219/469 |
| 4,567,349 | 1/1986 | Henry | 219/216 |
| 4,814,819 | 3/1989 | Torino | 219/469 |

*Primary Examiner*—Bruce A. Reynolds
*Assistant Examiner*—John A. Jeffery
*Attorney, Agent, or Firm*—Sandler, Greenblum and Bernstein

[57] ABSTRACT

Apparatus for fusing a thermoplastic image onto a substrate including a fuser element having a thin fusing member and apparatus for tensioning the thin fusing member.

20 Claims, 3 Drawing Sheets

FUSING APPARATUS AND METHOD

This application is a continuation of application Ser. No. 07/735,801, filed Jul. 25, 1991, now abandoned, which is a continuation of U.S. Ser. No. 07/293,431 filed Jan. 4, 1989, now U.S. Pat. No. 5,157,238.

FIELD OF THE INVENTION

The present invention relates generally to imaging apparatus and techniques and more particularly to apparatus and techniques for fusing of images on a substrate.

BACKGROUND OF THE INVENTION

Various techniques for image fusing are known in the patent literature. The Background of the Invention section of U.S. Pat. No. 4,724,303 includes a survey of the patent literature relating to the use of thermal energy for fixing toner images. The disclosure of U.S. Pat. No. 4,724,303 describes an instant-on fuser including a cylindrical, relatively thin metal cylinder supporting a resistive heating foil or printed circuit secured on the inside surface of the cylinder by a high temperature adhesive. The interior of the cylindrical tube contains ambient air. The heating foil or printed circuit is carried on a fiber glass substrate and the heating element is connected to electrical leads extending through caps on the ends of the cylindrical support. The combined thickness of the cylindrical member, the heating circuit and the adhesive is described as being between 0.005 and 0.01 inches.

U.S. Pat. No. 3,948,214 also describes instant start fusing apparatus. Here the fuser roll has a cylindrical member made of quartz or other material which transmits radiant energy from a source located on the interior of the cylindrical member. The cylindrical member has a first layer made of elastomeric material which transmits radiant energy. The first layer is covered with a second layer of material which absorbs radiant energy. A third layer of material covers the second layer of heat absorbing material to effect a good toner release characteristic on the fuser roll surface. The fuser roll layers are relatively thin and have an instant start capability to fuse toner images onto support material, such as paper.

U.S. Pat. No. 3,471,683 describes a heater roll suitable for use as a fuser roller in which heating is produced by a printed circuit formed into the surfaces of the roll, which receives electrical power through the roller shaft.

U.S. Pat. No. 4,015,027 describes an electrophotographic toner transfer and fusing method wherein a heated image is supported on a roller or belt intermediate transfer medium employed for pressure transfer of dry toner images onto paper. At column 11, line 29–column 12, line 38 there appears a detailed discussion of heating of images upon transfer thereof as proposed therein and as taught in the prior art including specifically U.S. Pat. No. 3,591,276 to Byrne.

Reference is made to FIGS. *5a–5c, 6i–6c, 7a* and *7b* of U.S. Pat. No. 4,015,027. It is seen that in nearly all cases described, the toner is heated to at least its melting point during the transfer stage. In a technique proposed in U.S. Pat. No. 4,015,027 and exemplified by FIG. 6(*a*), the toner is heated to at least its melting point prior to the transfer zone. In the transfer zone, the toner cools below its melting point during transfer and fusion.

A belt construction characterized in that it has a very low heat capacitance and a thickness of between 15 and about 200 microns is proposed in U.S. Pat. No. 4,015,027. In one embodiment the belt comprises a 50 micron layer of aluminized Kapton having a 25 micron coating of silicon rubber. Another embodiment employs a 12.5 micron layer of stainless steel instead of the Kapton together with a silicon rubber coating. A reflecting layer is incorporated in the belt to reduce heating thereof.

Reference is no made to the following published patent applications and issued patents in the field of electrophotography. GB published Patent Applications Nos. 2,169,416A and 2,176,904A and U.S. issued U.S. Pat. Nos. 3,990,696, 4,233,381, 4,253,656, 4,256,820, 4,269,504, 4,278,884, 4,286,039, 4,302,093, 4,326,644, 4,326,792, 4,334,762, 4,350,333, 4,355,883, 4,362,297, 4,364,460, 4,364,657, 4,364,661, 4,368,881, 4,378,422, 4,392,742, 4,396,187, 4,400,079, 4,411,976, 4,412,383, 4,413,048, 4,418,903, 4,420,244, 4,435,068, 4,439,035, 4,454,215, 4,460,667, 4,473,865, 4,480,825, 4,501,486, 4,522,484, 4,531,824, 4,538,899, 4,582,774, 4,585,329, 4,586,810, 4,589,761, 4,598,992, 4,603,766, 4,620,699, 4,627,705, 4,678,317, the disclosures of which are incorporated by reference herein.

SUMMARY OF THE INVENTION

The present invention seeks to provide improved fusing apparatus.

There is thus provided in accordance with a preferred embodiment of the present invention apparatus for fusing of an image onto a substrate including a fuser element and apparatus for heating the fuser element, the fuser element and the apparatus for heating being operative for heating the image so as to cause the image to adhere to the substrate and for cooling the fuser element sufficiently such that the adhesion of the image thereto is less than the cohesion of the image.

Additionally in accordance with an embodiment of the present invention there is provided apparatus for fusing of an image onto a substrate including a fuser element and apparatus for heating the fuser element, and wherein the fuser element has a heat capacity sufficient to heat the image to a temperature at which adhesion to the substrate is improved, and a heat capacity low enough so that the surface temperature of the fuser element is substantially reduced during fusing.

In accordance with one embodiment of the invention the image is a toner image and the apparatus for heating is operative to heat the toner image to a temperature below its melting point.

In accordance with another embodiment of the invention the image is a liquid toner image including particles and the apparatus for heating is operative to heat the liquid toner image to a temperature below the melting point of the particles.

In accordance with yet another embodiment of the invention the image is a liquid image including pigmented particles and the apparatus for heating is operative to heat the liquid image to a temperature below the melting point of the pigmented particles.

Further in accordance with an embodiment of the invention, the apparatus for heating is operative to heat the image to a temperature at which is solvates.

Additionally in accordance with an embodiment of the invention, the fuser element and the apparatus for heating are operative to cool the image below the solvation temperature.

Further in accordance with an embodiment of the invention, the image is a toner image and the apparatus for heating is operative to heat the toner image to a temperature above its melting point.

Additionally in accordance with an embodiment of the invention, the image is a liquid image including pigmented particles and the apparatus for heating is operative to heat the liquid image to a temperature above the melting point of the pigmented particles.

Further in accordance with an embodiment of the invention, the fuser element and the apparatus for heating are operative to cool the image to below the melting point.

Additionally in accordance with an embodiment of the invention the fuser element and the apparatus for heating are operative to increase the viscosity of the image during fusing thereof.

Further in accordance with a preferred embodiment of the invention, the fuser element and the apparatus for heating are operative to produce increased cohesion of the image during fusing thereof.

Additionally in accordance with a preferred embodiment of the invention, the fuser element comprises a thin walled cylinder.

Further in accordance with an embodiment of the invention, the thin walled cylinder has a thickness less than 125 microns.

Additionally in accordance with an embodiment of the invention there is provided apparatus for fusing an image onto a substrate including a fuser element and apparatus for heating the fuser element, wherein the fuser element comprises a thin walled cylinder of thickness less than 125 microns.

Additionally in accordance with an embodiment of the invention, there is provided a fuser element comprising a thin walled cylinder having a thickness less than 125 microns.

In accordance with an embodiment of the invention, the thin walled cylinder has a thickness less than about 50 microns.

Further in accordance with an embodiment of the invention, the thin walled cylinder has a thickness less than about 30 microns.

Additionally in accordance with an embodiment of the invention, the thin walled cylinder comprises a layer of Kapton and a thin release layer.

Further in accordance with an embodiment of the invention the thin walled cylinder has a thickness less than about 12 microns.

Additionally in accordance with an embodiment of the invention, the thin walled cylinder comprises a metallic material.

Further in accordance with an embodiment of the invention, the thin walled cylinder comprises a layer of Nickel alloy and a thin release layer.

Additionally in accordance with an embodiment of the invention there is also provided apparatus for passing electrical current through the thin walled cylinder for producing direct resistance heating thereof.

Further in accordance with an embodiment of the invention the fuser element also comprises means for axially tensioning the thin walled cylinder.

Additionally in accordance with an embodiment of the invention, the thin walled cylinder is a pneumatically pressurized thin walled cylinder.

Additionally in accordance with a preferred embodiment of the invention there is provided a method for fusing of an image onto a substrate comprising the steps of:

providing a fuser element; and heating the fuser element to cause the image to adhere to the substrate; and cooling the fuser element sufficiently such that the adhesion of the image thereto is less than the cohesion of the image.

Further in accordance with a preferred embodiment of the invention there is provided a method for fusing of an image onto a substrate comprising the steps of:

providing a fuser element; and heating the fuser element, wherein the fuser element has a heat capacity sufficient to heat the image to a temperature at which adhesion to the substrate is improved, and a heat capacity low enough so that the surface temperature of the fuser element is substantially reduced during fusing.

Additionally in accordance with an embodiment of the invention the image is a toner image and the step of heating is operative to heat the toner image to a temperature below its melting point.

Further in accordance with an embodiment of the invention the image is a liquid toner image including particles and the step of heating is operative to heat the liquid toner image to a temperature below the melting point of the particles.

Additionally in accordance with an embodiment of the invention the image is a liquid image including pigmented particles and the step of heating is operative to heat the liquid image to a temperature below the melting point of the pigmented particles.

Further in accordance with an embodiment of the invention the step of heating is operative to heat the image to a temperature at which is solvates.

Additionally in accordance with an embodiment of the invention the fuser element and the step of heating are operative to cool the image below the solvation temperature.

Further in accordance with an embodiment of the invention, the image is a toner image and the step of heating is operative to heat the toner image to a temperature above its melting point.

Additionally in accordance with an embodiment of the invention the image is a liquid image including pigmented particles and the step of heating is operative to heat the liquid image to a temperature above the melting point of the pigmented particles.

Further in accordance with an embodiment of the invention, the fuser element and the step of heating are operative to cool the image to below the melting point.

Additionally in accordance with an embodiment of the invention the fuser element and the step of heating are operative to increase the viscosity of the image during fusing thereof.

Further in accordance with an embodiment of the invention the fuser element and the step of heating are operative to produce increased cohesion of the image during fusing thereof.

Additionally in accordance with an embodiment of the invention the fuser element comprises a thin cylinder and the method also comprises the step of passing electrical current through the thin walled cylinder for producing direct resistance heating thereof.

Further in accordance with an embodiment of the invention the fuser element comprises a thin cylinder and the method also comprises the step of axially tensioning the thin walled cylinder.

Additionally in accordance with an embodiment of the invention, the fuser element comprises a thin cylinder and the method also comprises the step of pneumatically pressurizing the thin walled cylinder.

BRIEF DESCRIPTION OF THE DRAWINGS

The present invention will be understood and appreciated more fully from the following detailed description taken in conjunction with the drawing in which.

DETAILED DESCRIPTION OF THE INVENTION

Figure 1:
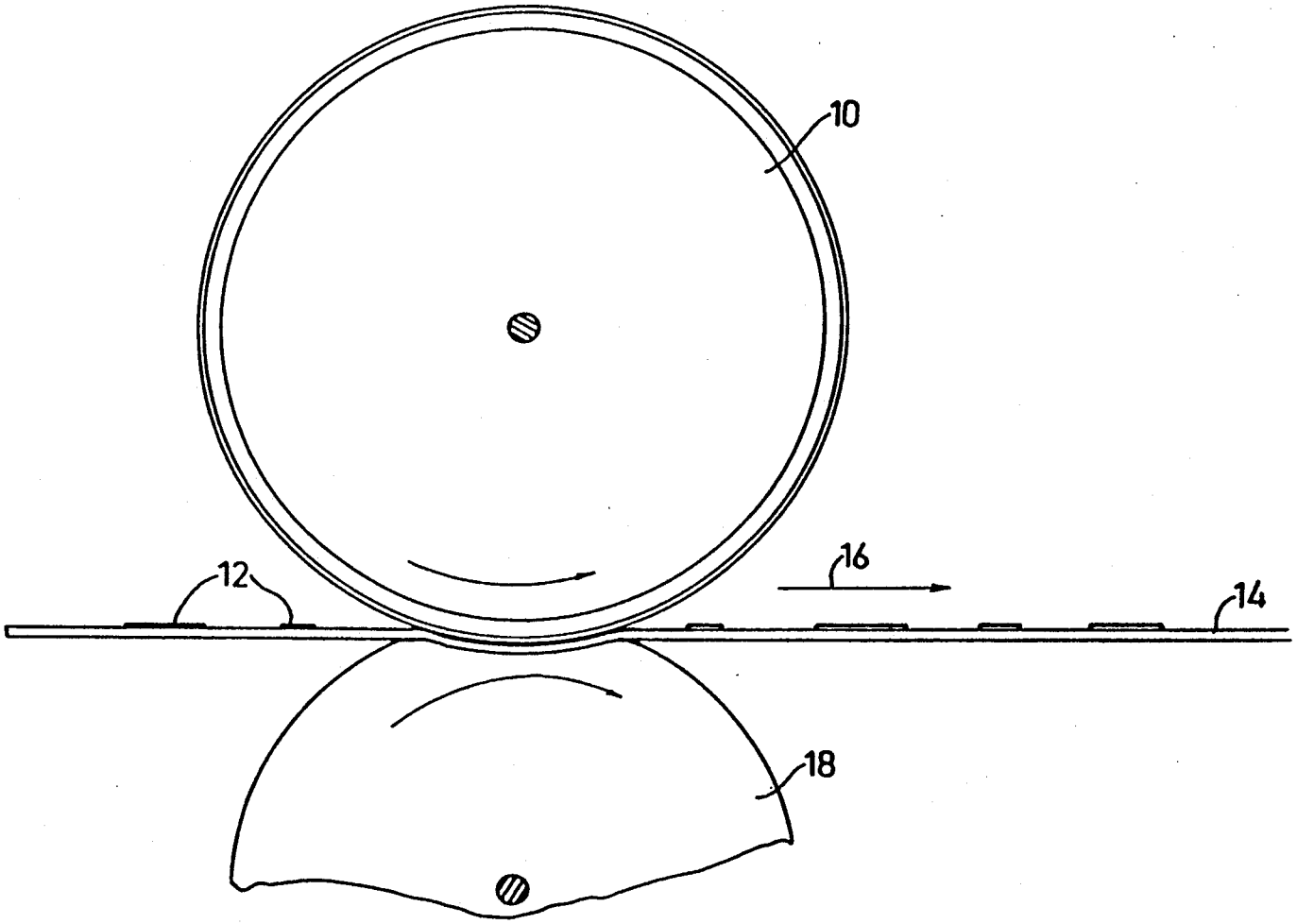
FIG. 1 is a generalized schematic sectional illustration of fuser apparatus constructed and operative in accordance with a preferred embodiment of the present invention.

Referring to FIG. 1 there is shown fusing apparatus constructed and operative in accordance with a preferred embodiment of the present invention and comprising a fuser roller 10 which is operative to fuse an image, such as a toner image 12, on a substrate 14, such as paper. The image bearing substrate 14 moves in a direction indicated by an arrow 16 between fuser roller 10 and a platan roller 18.

Toners suitable for the present invention include, but are not limited to, powder toners, toners of the type described in the examples in Published Patent specification GB 2169416A, or liquid toners, comprising pigmented solid particles which solvate at temperatures below the melting point of the solid particles, as well as liquid toners which do not solvate at a temperature below the melting point of the pigmented solid particles therein.

The fuser apparatus of FIG. 1 may be used in connection with and form part of imaging apparatus such as an electrostatographic printing machine or alternatively any other suitable types of imaging apparatus. Examples of systems in which the present invention may be employed include electrophotography, electrography, ionography, xero-printing, gravure-like printing and electrostatic printing.

For convenience, the description which follows is presented in the context of an electrophotographic system employing liquid toner, but without limiting the applicability of the present invention.

Reference is now made to FIGS. 2A–5B which illustrate four alternative embodiments of fuser rollers constructed and operative in accordance with a preferred embodiment of the invention.

According to a preferred embodiment of the invention, the fuser roller comprises a thin-walled cylinder 70. Cylinder 70 preferably is formed of two rigid end portions 72 and 74 and a thin cylindrical layer 76 typically coated with a release layer 78. Typically materials and thicknesses are as follows:

Layer 76
- Material: Kapton (DuPont)
- Thickness: 20 microns

Release layer 78
- Material: Teflon (DuPont)
- Thickness: 10 microns.

According to an alternative embodiment of the invention, the layer 76 may be a 10 micron thick film of nickel alloy, such as nickel cobalt or nickel chromium and the release layer may be a 2 micron thick layer of Teflon.

In accordance with a preferred embodiment of the invention, the thin cylindrical layer 76 is axially tensioned, as by a spring arrangement 80, sufficient to eliminate most surface irregularities. For the above-described example employing Kapton, a suitable tension is 200 $Kg/cm^2$.

Further in accordance with a preferred embodiment of the invention, enhanced rigidity and surface uniformity of the thin-walled cylinder 70 is provided by pneumatically pressurizing the interior of the cylinder, by any suitable pressurized gas. A valve 82 may be provided for this purpose.

In accordance with a preferred embodiment of the present invention, the thin walled cylinder 70 is heated by the passage of electrical current along layer 76 via conductors 84 and 86, which establish an electrical circuit via end portions 72 and 74. In this case layer 76 must either be or include a layer which is an electrical conductor of suitable characteristics.

In the above stated example, the electrical power required to provide desired heating of fusing element 70 is relatively low.

Figure 3A:
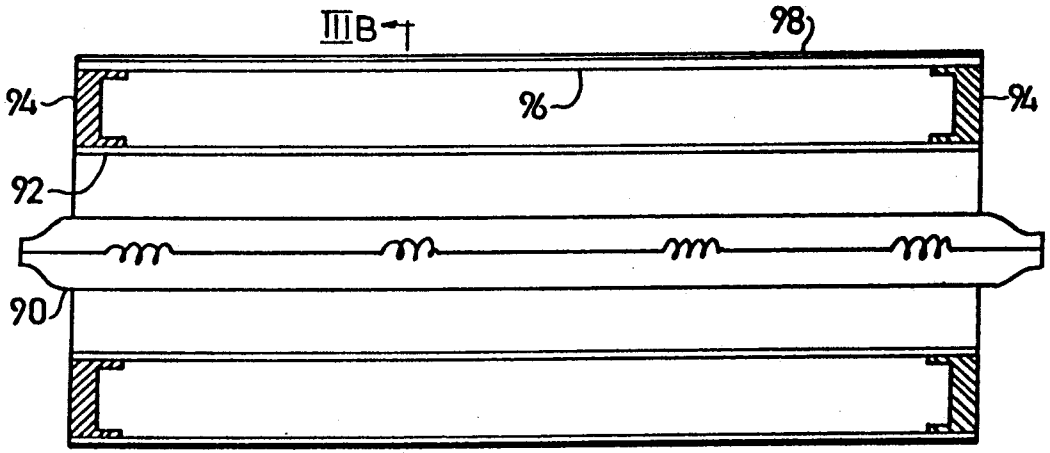
FIG. 3A is a side sectional illustration of a heated thin-walled fuser element constructed and operative in accordance with an alternative embodiment of the present invention.
Figure 3B:
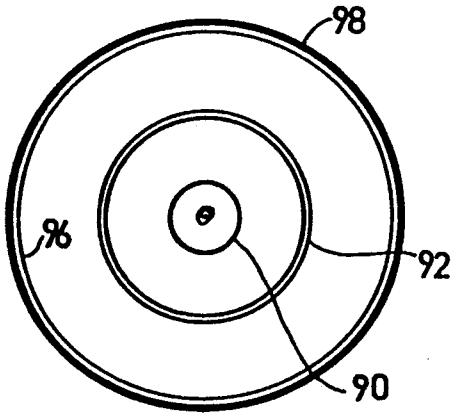
FIG. 3B is a sectional illustration taken along the lines IIIB—IIIB of FIG. 3A.

Reference is now made to FIGS. 3A and 3B which illustrate an alternative embodiment of heated fuser element wherein heating is provided by radiation. Here a heating lamp 90 is disposed interior of a radiation transmissive tube 92, such as a quartz tube. Disposed in generally coaxial surrounding relationship with quartz tube 92 and supported on annular end supports 94 is a fuser layer 96 having formed therein a release layer 98.

Figure 2A:
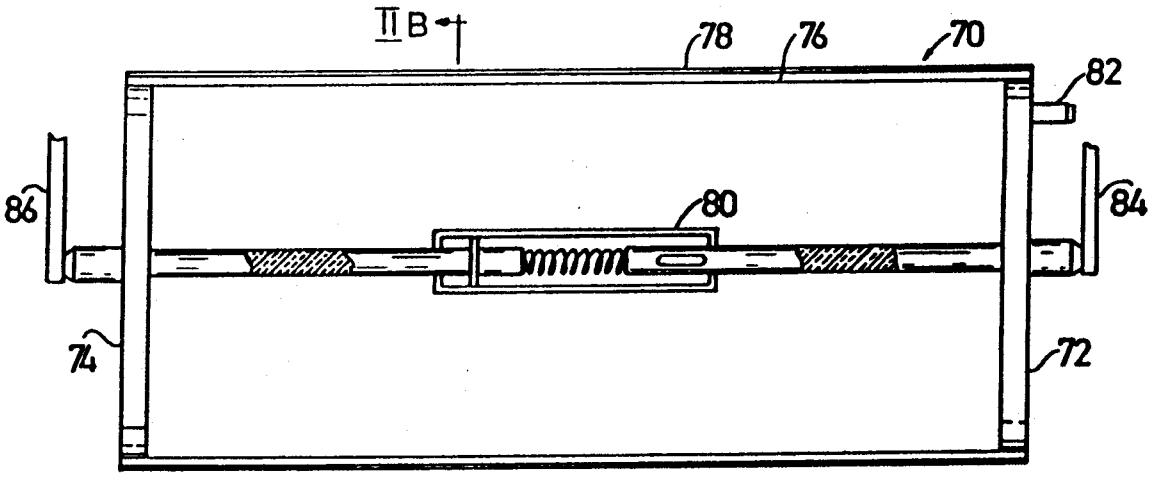
FIG. 2A is a side sectional illustration of a heated thin-walled fuser element constructed and operative in accordance with a preferred embodiment of the present invention.
Figure 2B:
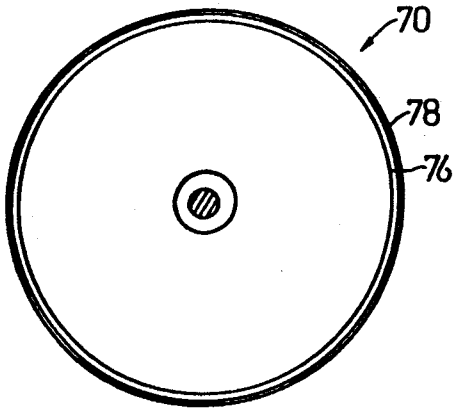
FIG. 2B is a sectional illustration taken along the lines IIB—IIB of FIG. 2A.

According to a preferred embodiment of the invention, layers 96 and 98 may be identical to layers 76 to 78 in the embodiment of FIGS. 2A and 2B. In such a case tensioning apparatus of the type illustrated in FIG. 2A is preferably employed.

Figure 5A:
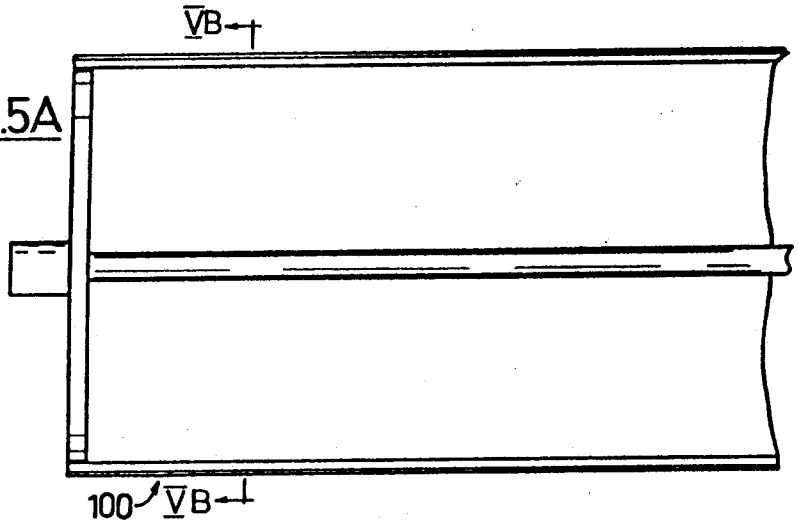
FIG. 5A is a side sectional illustration of a heated thin-walled fuser element constructed and operative in accordance with yet another embodiment of the present invention.
Figure 5B:
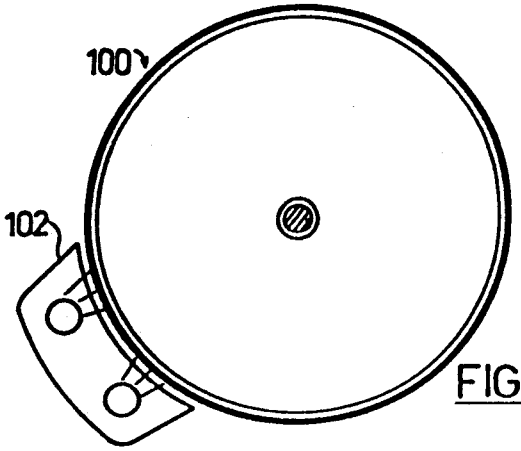
FIG. 5B is a sectional illustration taken along the lines VB—VB of FIG. 5A.

Reference is now made to FIGS. 5A and 5B, which illustrate an alternative arrangement of heated fuser roller. The roller 100 is preferably of the thin walled type described above. Heating of the roller 100 is provided externally of the roller by a heating station 102. In the illustrated embodiment, the heating station 102 employs radiant heaters, which heat the roller by radiation. Alternatively the heating station 102 may heat the roller 100 by conduction through direct contact with the roller.

Figure 4A:
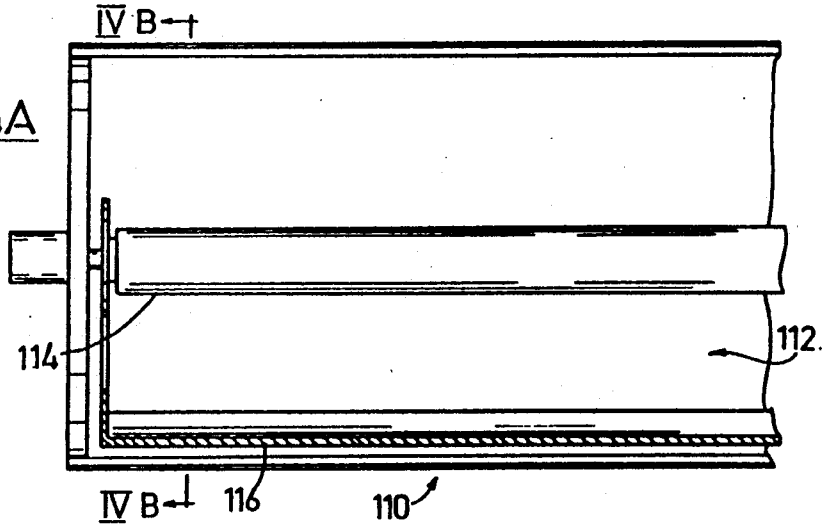
FIG. 4A is a side sectional illustration of a heated thin-walled fuser element constructed and operative in accordance with a further alternative embodiment of the present invention.
Figure 4B:
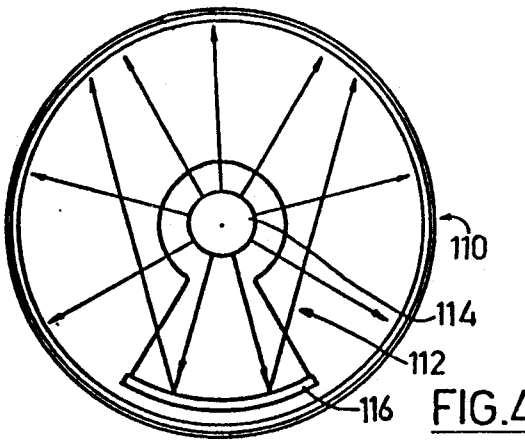
FIG. 4B is a sectional illustration taken along the lines IVB—IVB of FIG. 4A.

Reference is now made to FIGS. 4A and 4B, which illustrate a further alternative of heated fuser roller. Here, once again, a roller 110 is preferably thin walled. Heating of the roller 110 is provided by an internal radiant heater assembly 112 which is mounted internally of roller 110. Radiant heater 112 comprises an elongate radiative heat source 114 which is associated with a reflector 116, which prevents direct radiation from source 114 from reaching the area at which fusing occurs, thus providing differential heating of roller 110 and permitting cooling of the image during fusing as described hereinabove.

The weight of the reflector 116 ensures that when the reflector 116 is pivotably mounted with respect to the roller, they will retain the orientation illustrated notwithstanding rotation of the roller 110.

It will be understood that it is a particular feature of the invention that the hot fuser roller has a heat capacity per unit area which is sufficient to heat the toner material to the proper fusing temperature during the contact period, with the effective heat capacity per unit area being such that the thermal transfer to the paper is high enough to reduce the temperature of the roller surface, so that adhesion of the image to that surface is reduced. Simply stated, the thin cylindrical member has an effective heat capacity sufficient to heat the toner material during fusing sufficiently, and then cool itself, before disengagement from the paper-image combination. Functionally, the fuser roller delivers a measured amount of heat energy while cooling.

Furthermore, the particular features of provision of the tensioning and/or pressurizing features of the roller allow for the use of material thin enough to provide this particular amount of heat capacity, and thin enough so that lateral heat transfer is relatively small, without which features the thin walled cylinder would not have the required rigidity.

As the image is cooled, its viscosity and cohesiveness are increased. The adhesion of the image to the substrate is greater than its adhesion to the release coated fuser roller, thus substantially preventing transfer of the image to the roller. Clearly the temperature to which the image must be heated and cooled depends on the characteristics of the material. For solid toners and for non solvating liquid toners this temperature preferably approximates the melting point of the solids, for solvating toners, this temperature preferably approximates the solvation temperature.

Additionally, it is the provision of a thin walled cylinder which makes the direct heating of the surface possible.

Additionally, the low heat capacity and transverse heat conduction combine to allow the fuser to heat substantially during the relatively long period before the fusing operation, without high heat requirements and without excessive heat transfer to the paper.

It is thus a particular feature of the present invention that there is provided a fuser element including a thin surface or member which supports the image during transfer, the thin surface having an effective heat capacity which is less than that of the substrate.

The thin surface may be a cylindrical surface or any other suitable configuration. Normally, due to its thinness, the thermal conductivity along the surface is sufficiently small such that the thermal mass of the supports, such as end rollers for a cylindrical surface such as that shown in the drawings, may be disregarded.

The advantages of the use of a fuser element having the proper effective thermal mass are summarized below:

a. enabling the image being fused to cool during transfer, as has already been described;

b. enabling rapid cooling of the fuser;

c. limiting the amount of thermal energy passed to the paper and thus limiting paper deformation.

d. low electrical power requirements.

e. "instant on" start up.

It will be appreciated by persons skilled in the art that the present invention is not limited by what has been particularly shown and described hereinabove. Rather the scope of the present invention is defined only by the claimed which follow:

We claim:

1. Apparatus for fusing of an image onto a substrate comprising:

a fuser element; and means for heating said fuser element, wherein said fuser element comprises a thin walled cylinder having end portions and a cylindrical fuser surface therebetween and wherein said thin walled cylinder has a thickness of less than 125 microns which is backed by a solid structural support at said end portions, which is unbacked by a solid structural support between said end portions and which is supported by gas pressure.

2. Apparatus according to claim 1 wherein said thin walled cylinder has a thickness less than about 50 microns.

3. Apparatus according to claim 1 wherein said thin walled cylinder has a thickness less than about 30 microns.

4. Apparatus according to claim 3, wherein said thin walled cylinder comprises a metallic material.

5. Apparatus according to claim 4, wherein said thin walled cylinder comprises a layer of Nickel alloy and a thin release layer.

6. Apparatus according to claim 3 and also comprising means for passing electrical current through said thin walled cylinder for producing direct resistance heating thereof.

7. Apparatus according to claim 1 wherein said thin walled cylinder comprises a layer of Kapton and a thin release layer.

8. Apparatus according to claim 1 wherein said thin walled cylinder has a thickness less than about 12 microns.

9. Apparatus according to claim 1 and also comprising:

a) a backing roller adjacent to the fuser element;

b) means for passing the substrate between the fuser element and the backing roller at the fusing region;

c) means for pressing the fuser element to the substrate and the backing roller to apply pressure to the image.

10. Apparatus according to claim 9 wherein said fuser element deforms the backing roller at the fusing region without substantially deforming the fuser element.

11. A fuser element comprising a thin walled cylinder having end portions and a cylindrical fuser surface therebetween and wherein said thin walled cylinder has a thickness of less than 125 microns which is backed by a solid structural support at said end portions, which is unbacked by a solid structural support between said end portions and which is supported by gas pressure.

12. Apparatus according to claim 11 wherein said thin walled cylinder has a thickness less than about 50 microns.

13. Apparatus according to claim 11 wherein said thin walled cylinder has a thickness less than about 30 microns.

14. Apparatus according to claim 13 wherein said thin walled cylinder comprises a metallic material.

15. Apparatus according to claim 14, wherein said thin walled cylinder comprises a layer of Nickel alloy and a thin release layer.

16. Apparatus according to claim 13 and also comprising means for passing electrical current through said thin walled cylinder for producing direct resistance heating thereof.

17. Apparatus according to claim 11 wherein said thin walled cylinder comprises a layer of Kapton and a thin release layer.

18. Apparatus according to claim 11 wherein said thin walled cylinder has a thickness less than about 12 microns.

19. Apparatus for fusing of an image onto a substrate comprising:

a fuser element; and means for heating said fuser element, wherein said fuser element comprises a thin walled cylinder having end portions and a cylindrical fuser surface therebetween and wherein said thin walled cylinder has a thickness of less than 125 microns which is backed by a solid structural support at said end portions and which is unbacked by a solid structural support between said end portions and also comprising means for axially tensioning said thin walled cylinder.

20. A fuser element comprising a thin walled cylinder having end portions and a cylindrical fuser surface therebetween and wherein said thin walled cylinder has a thickness of less than 125 microns which is backed by a solid structural support at said end portions, which is unbacked by a solid structural support between said end portions and also comprising means for axially tensioning said thin walled cylinder.

* * * * *